US005347609A

United States Patent [19]

Huff

[11] Patent Number: 5,347,609

[45] Date of Patent: Sep. 13, 1994

[54] METHOD AND ASSEMBLY FOR CONVERTING A MOBILE GAS RANGE TO COMBINATION GAS-ELECTRIC RANGE

[76] Inventor: William W. Huff, 38022 Sierra Hwy., Palmdale, Calif. 93550

[21] Appl. No.: 941,909

[22] Filed: Sep. 8, 1992

[51] Int. Cl.[5] ..... F24C 1/06; H05B 3/68

[52] U.S. Cl. ..... 392/309; 219/443; 219/447; 219/448

[58] Field of Search ..... 392/309, 308; 219/443, 219/450, 445, 463, 447, 448

[56] References Cited

U.S. PATENT DOCUMENTS

| | | | |
|---|---|---|---|
| 1,667,521 | 4/1928 | Alber | 392/309 |
| 2,414,162 | 1/1947 | Morton | 219/445 |
| 2,424,412 | 7/1947 | Myers | 219/450 |
| 2,658,987 | 11/1953 | Ogden | 392/309 |
| 2,733,332 | 1/1956 | Mason | 219/463 X |

FOREIGN PATENT DOCUMENTS

| | | | |
|---|---|---|---|
| 935426 | 2/1948 | France | 392/309 |
| 47944 | 5/1930 | Norway | 392/309 |
| 875656 | 8/1961 | United Kingdom | 392/309 |

*Primary Examiner*—Anthony Bartis
*Attorney, Agent, or Firm*—David L. Tingey

[57] ABSTRACT

A conversion assembly for converting a gas burner of a multi-burner gas operated cooking range of a recreational vehicle to an electric burner for operation by the electrical generator of the vehicle or by an external campground electrical power supply so that the range is both electrically and gas operable includes an electric heating element sized for insertion into the recess of the recreational vehicle range deck in place of a removed gas burner, an electrical control mountable on the range control panel in place of the removed gas control valve of the removed burner and a spring clip engageable with a radial support for the heating element for securing the element in the recess. A threaded plug is provided for plugging the hole in the range gas line left by removal of the gas control valve. A cover is provided for placement over the electric control for preventing spillage from damaging the control and wiring thereof.

8 Claims, 6 Drawing Sheets

METHOD AND ASSEMBLY FOR CONVERTING A MOBILE GAS RANGE TO COMBINATION GAS-ELECTRIC RANGE

The present invention relates generally to cooking ranges and, more particularly, to surface cooking units suitable for use in recreational vehicles.

BACKGROUND OF THE INVENTION

Typically, cooking or heating units in recreational vehicles are operated by bottled gas, usually propane or natural gas. However, many recreational vehicle owners spend much of their time in recreational vehicle parks or campgrounds where electricity is available and many times at no additional cost. The recreational vehicle owner for convenience and cost considerations would prefer to connect his vehicle's range to available electricity sources provided at campground and park sites yet maintain capability to operate on gas when electricity is not available. As there are refrigerators and water heaters available that operate on both bottled gas or electricity, it is desirable to similarly have a heating range for recreational vehicles that operates on both bottled gas and electricity, or a means for converting, or partially converting, a traditional recreational vehicle gas range to electricity.

It is therefore an object of this invention to provide an assembly suitable for converting traditional gas-operated heating ranges to combination gas and electric ranges.

Another object is to provide a convenient connection of a recreational vehicle range partially converted to electricity to a conventional external electric outlet typically provided at many parks and campgrounds.

Another object is to retain capability to operate the range with bottled gas for occasions when connection to external electric outlets is not convenient.

Still another object is to separate the gas operated elements of the range from electric heating elements of the range for safety.

SUMMARY OF THE INVENTION

In accordance with the present invention, there is provided an assembly for converting a portion of the heating elements of a recreational vehicle range from gas to electricity use. The assembly when installed in a traditional recreational vehicle range replaces one or more gas heating elements with electric heating elements. Less than all elements are converted to retain both gas and electric operating capability. Installed in existing openings for gas elements in the range, the electric operating elements substitute gas heating elements and remain separated from other gas operated elements remaining in the range. Both sources can be used simultaneously.

The assembly comprises two electric controls that allow for a full range of desired cooling temperatures; a 750 watt and a 625 watt electric element of the "cal rod" type that operate on 30 ampere power available at most campgrounds or from power provided by a 125-volt generator in the vehicle; a power cord for external connection of the range to a campground electric outlet or for connection to a vehicle's internal vehicle 125 volt power system; required wiring; and necessary adapters.

On electric heating element produces 750 watts of heat and the other produces 625 watts of heat, although other sizes and combinations could be employed without deviating from the intent of the invention. The power consumed is limited by the requirement that the assembly be connected to a conventional 125-volt power source which may be limited to a electric current of as little as 20 amps, though more commonly 30 amp power outlets are available. These electric heating elements are physically sized to fit in range top recesses that are typically circular, each with a wide concentric opening, which remain open in the conversion for general venting.

A conventional thermostatic power control is electrically connected to each electric burner, between the power source and external power source to regulate the burner temperature. Each control is intended to replace a gas control in the range corresponding to the gas burner that each element replaces upon installation of the assembly of this invention.

To prevent spills from falling on the electrical connections and controls, a control cover is mounted on the range over each control as shown in FIG. 5.

FIG. *7a* and *7b* are front views of a spring clip with continuous curvature bends and curvature approximated by a plurality of connected segments, respectively.

Figure 8:
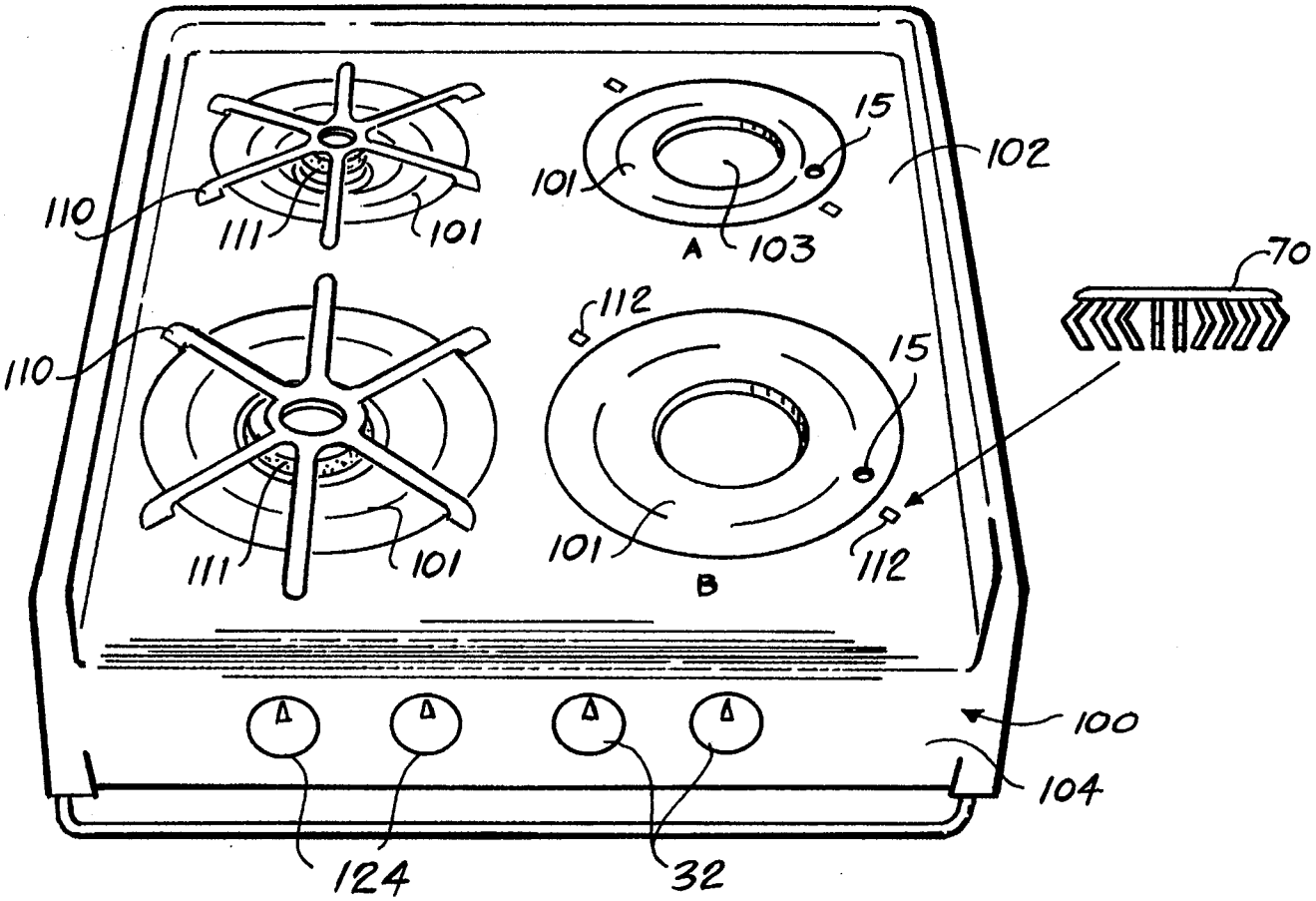

FIG. 8 shows a grate hole plug for closing a hole in the range top deck.

DESCRIPTION OF A PREFERRED EMBODIMENT

As indicated, this assembly is intended for installation in a gas operated recreational vehicle range. A typical such range has top deck with a recess for each burner. A gas burner grate with radial extensions is mounted over each range deck recess. In the deck recess under each grate normally is a gas burner connected in fluid communication to a pilot light by means of a pilot tube. Gas control valves are also mounted in the range, typically on a front panel. The valves are connected by gas conducting pipes to a central gas line. Gas is provided through the valves to each burner by means of a gas tube connected in fluid communication therebetween. The central gas line is connected to a gas regulator to which is attached an external main gas line supplying gas to the range.

Figure 1:
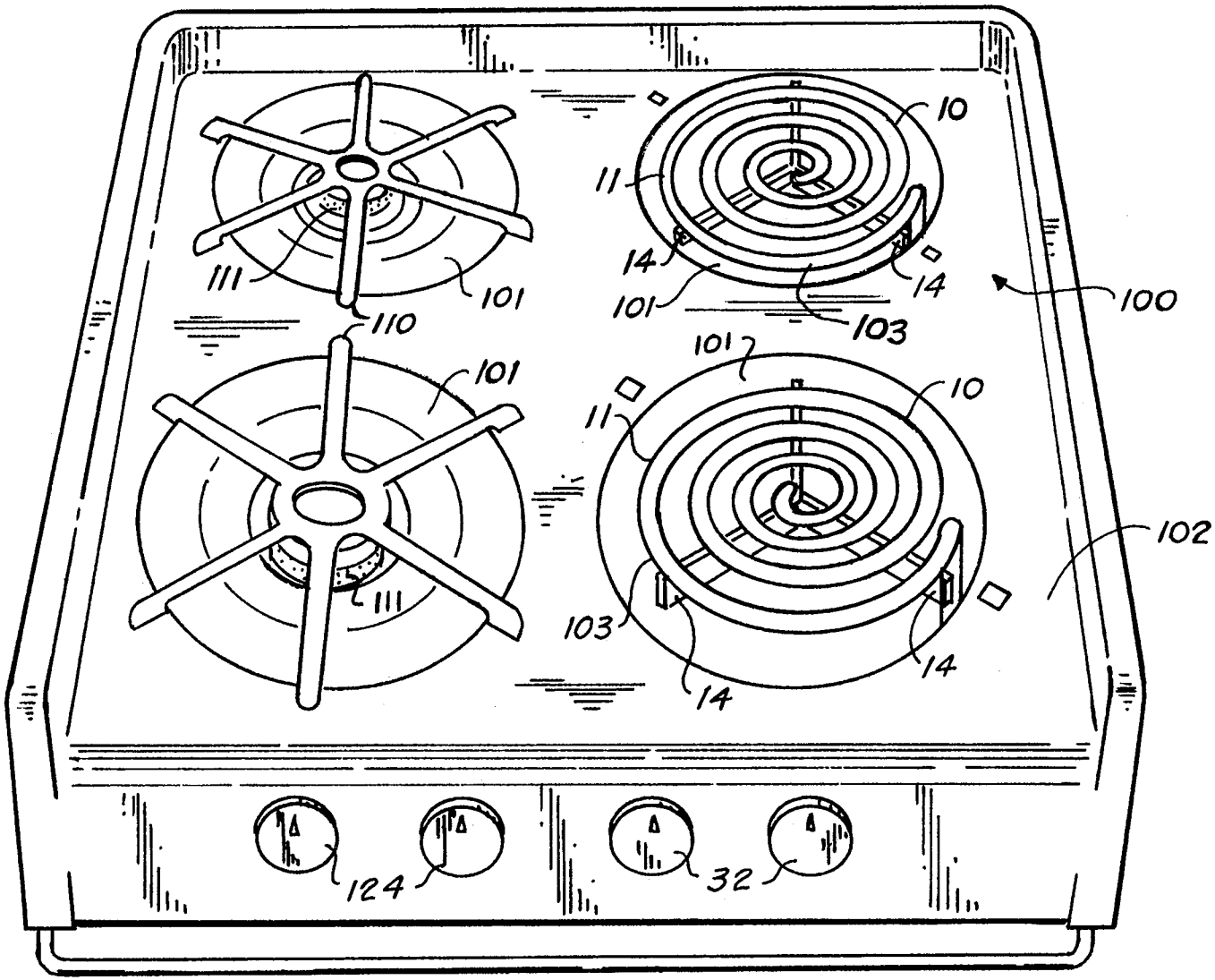
FIG. 1 is a perspective view of a recreational vehicle range containing the assembly of this invention.
Figure 2:
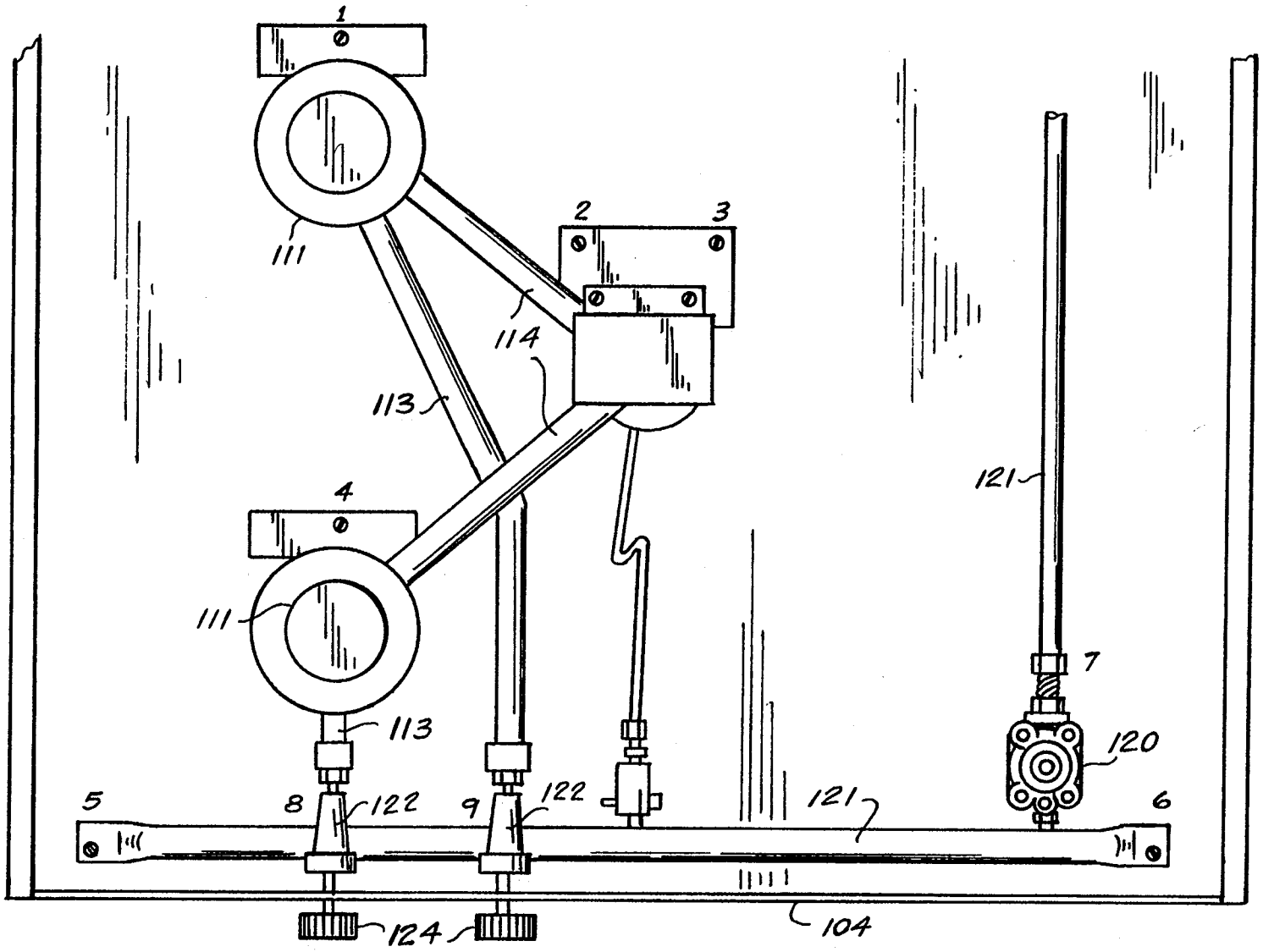
FIG. 2 is a perspective top view of a recreational vehicle range with the range top deck removed to show gas burner elements before installation of this invention.
Figure 3:
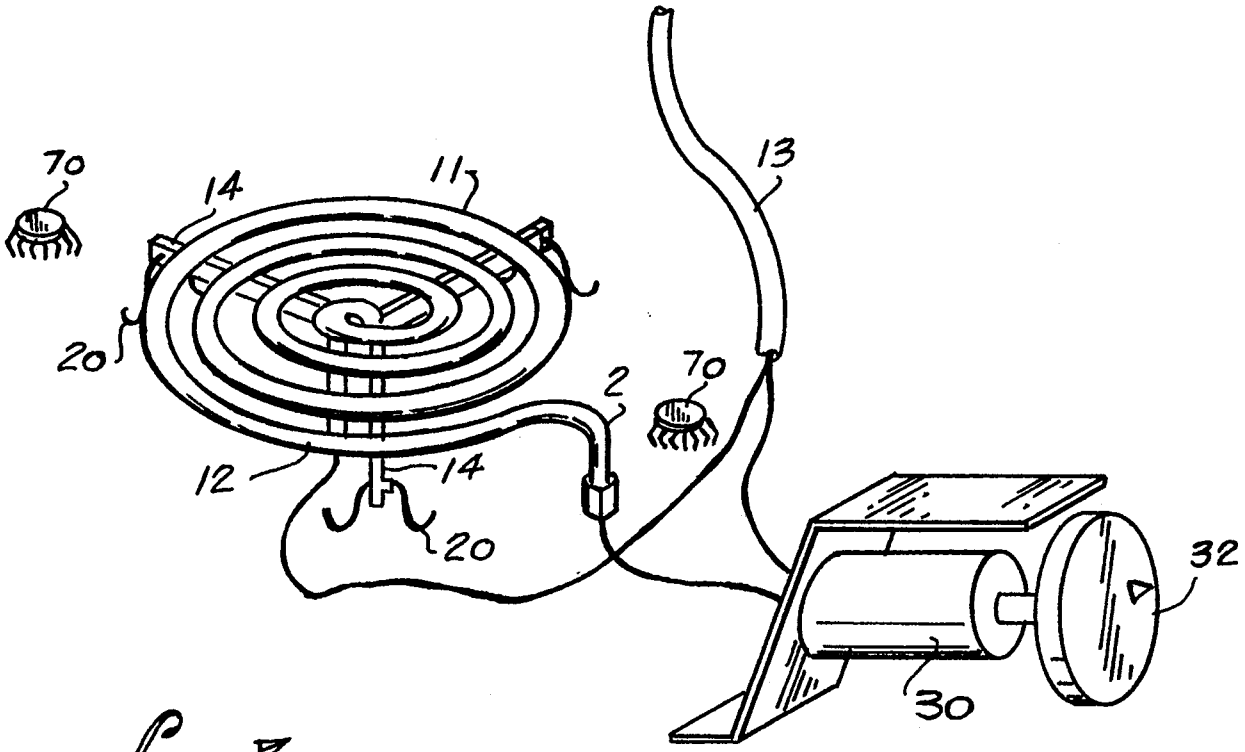
FIG. 3 is a perspective view of the elements of the invention.
Figure 4:
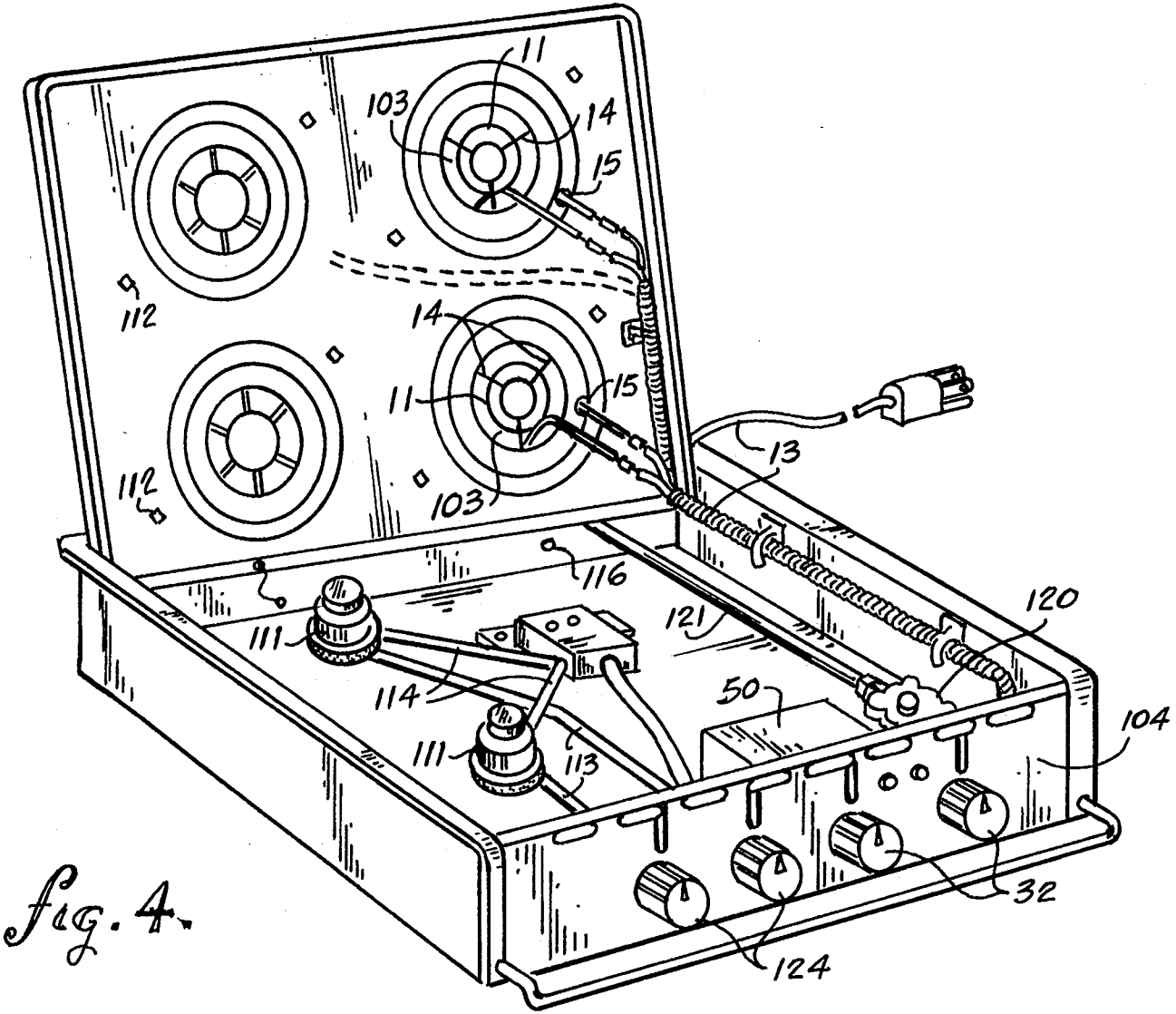
FIG. 4 is a perspective view of a recreational vehicle range showing the range top lifted, exposing beneath 2 gas burners and 2 electric burners installed on the range top.
Figure 7A:
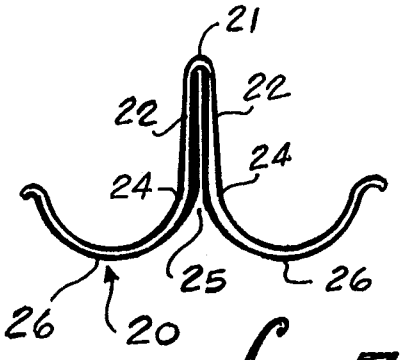
Figure 7B:
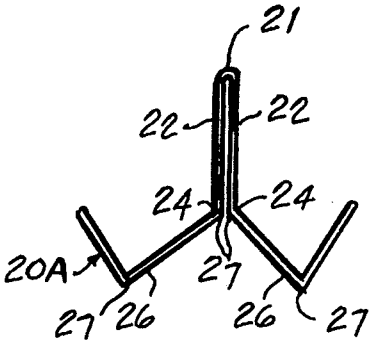
Figure 6:
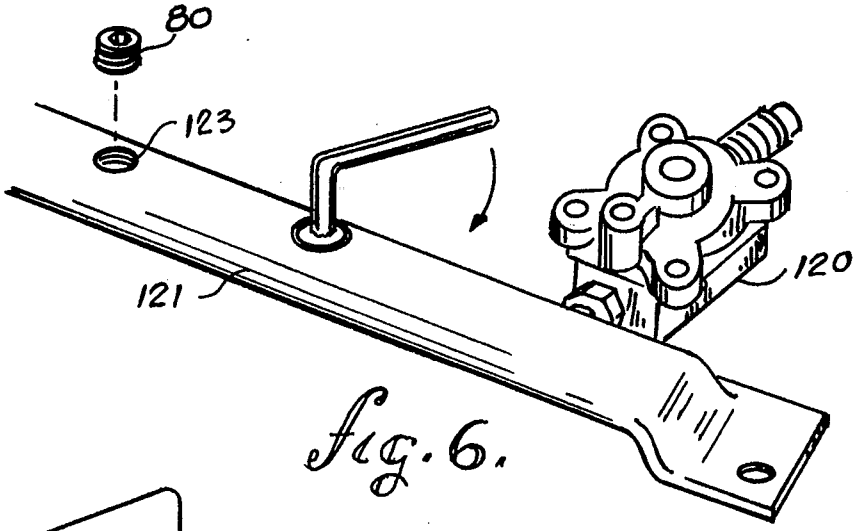
FIG. 6 is a perspective view of a gas valve regulator connected to a central gas line with a threaded plug for closing the central gas line after removal of a gas control valve.

Referring to the drawings, and particularly to FIG. 3, the conversion assembly of the present invention is seen to consist generally of several components including an electric heating element 10, a spring clip 20, an electric control switch 30, wire 32 electrically connecting these components to a power source 13, represented by a cable depicted in FIG. 3 which is connected to an external power source, not shown, and a control cover plate 50.

The electric heating elements 10 are generally circular in outer dimension formed by a metallic spiral element 11, which may be a tubular sheath or equivalent electrical resistive conductor in a continuous spiral in a horizontal plane, the ends 12 of which extend down out of the plane for connection to wires 32. The spiral element 11 rests on a plurality of attached radial supports 14, typically 3. When installed in a recreational vehicle range 100 having range top recesses 101 in a range top deck 102, the radial supports 14 rest on and within the range top recesses 101 with the spiral elements 11 protruding slightly out of a recess 101 and above the range top deck 102.

Each electric heating element 10 is secured to the range top recess by a spring clip 20 in FIG. *7a* and 20A in FIG. *7b*. The spring clip 20 is typically formed from spring wire stock with a first bend 21 at its center forming a first point of flexure, with two lengths extending from the first bend approximately in parallel to a point of second bend 24 on each length. The spring lengths 22 from the first point of flexure 21 to the second bend 24 form a channel 25 therebetween sized to fit over a heating element radial support 14. At the point of second bend 24 each length 22 bends away from the other length in an upward-oriented, concave curvature forming a second point of flexure 26. In an alternative embodiment, the continuous concave curvature can of the spring clip 20A shown in FIG. *7b*, be approximated by a 2 or more bends 27 in the length 22.

The spring clip 20 secures a heating element 10 connected to a plurality of radial supports 14 to a range top recess 101 as the channel 25 of the spring clip 20 is placed over a radial support 14 placed in a recess 101, and the spring clip curved lengths are then moved under spring bias, flexing the spring clip 20 at the first and second points of flexure, through a recess hole 103 and under the range top deck 102. The spring clip 20 then remains under spring tension, holding the heating element 10 in place in the recess 101.

Figure 5:
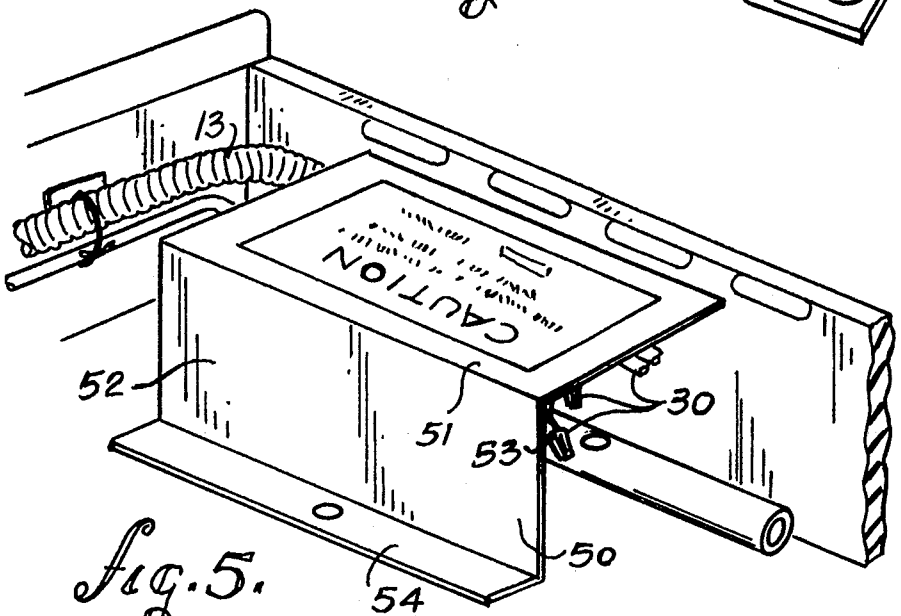
FIG. 5 is a perspective view of a control cover mounted on a range over a thermostatic electric control.

To prevent spills from falling on the electrical connections and controls, control cover 50 is mounted on the range 100 over each control 30 as shown in FIG. 5. The control cover plate 50 comprises a top portion 51 and a rear portion 52 joined at a slightly obtuse angle 53 so that spills tend to fall off the plate 50. To the rear portion 52 may be joined a base 54 for supporting the cover plate 50 on the range 100. The cover plate 50 is intended to be secured to the range 100, such as with a screw through the base and into the range, such that the top portion covers and protects the thermostatic power control.

To install the assembly of this invention in the right 2 gas burner locations, burner grates 110 are removed over their respective burners 111, leaving holes 112 in the range deck 102 in which the grates 110 fit. Grate hole plugs 70 are also provided in this assembly to close these grate holes 112. To prepare for gas burner removal, the gas regulator 120 is removed from the main gas line 121 with the gas supply disconnected. All burners 111 are then detached from the range 100. The right burners and their attached gas tubes 113 and pilot tubes 114 are then removed. Burner replacement at other locations is performed similarly. With the burners removed, the central gas line 121 with gas control valves 122 is separated from the range front panel 104. The gas control valves 122 associated with the removed burners are then separated from the central gas line 121, leaving threaded holes 123 in the line 121 which are closed with threaded plugs 80. The central gas line 121 and remaining gas burners 111 with their associated control valves 122, gas tubes 113 and pilot tubes 114 are then reattached to the range 100, and the regulator 120 is reconnected to an external main gas supply line.

With the gas burners to be replaced thus removed and the range gas system restored, electric elements 10 are installed. Electric controls 30 are mounted in the range front panel 104 replacing the removed gas control valves 122. Pilot light holes (34) may be drilled in the range front panel and pilot lights (36) may be mounted therein. A power cord hole (116) may also drilled in the range 100, typically in a rear range panel, and a power cord passed therethrough. One heating element hole 15 is also drilled in each of the range top recesses 101 from which gas burners 111 were removed and one end of the electric spiral element 11 is passed therethrough with the electric element 11 resting in the range top recess 101. The other heating element end is passed through the recess hole 103.

Having described the invention, what is claimed is:

1. An assembly for converting a gas burner of a gas-operated range of the type typically provided in a recreational vehicle to an electric burner suitable for operation by a recreational vehicle's 125-volt generator or by connection to an external 125-volt power supply such as is commonly available at parks and campgrounds so that the recreational vehicle range has a range with both electrically operated and gas operated range top burners with the electric burner separated on the range from the gas operated burners, comprising, an electric heating element sized for mounting in spaced-apart relation to other electric or gas-operated burners on a range top, a plurality of radial supports attached under the electric heating element for supporting the electric heating element on the range top, an electric control electrically connected to the heating element for controlling temperature of the heating element, means for electrically connecting the electric heating element to an electric power source, a control cover plate having a top portion for covering and protecting the power control when mounted, a base portion with means for mounting the cover plate to the range, and a rear portion supporting the top portion in spaced relation to the base portion, and a threaded plug for replacing a gas control valve associated with a gas burner removed from a threaded hole in a range central gas line, a spring clip for securing the electric heating element to the range, further comprising two lengths joined at a first bend forming a first point of flexure, the lengths extending from the first bend approximately in parallel to a point of second bend for each length forming a channel therebetween, the channel sized to fit over a heating element radial support, each length then bending at its respective point of second bend away from the other length in an upward-oriented concave curvature forming a second point of flexure.

2. The invention of claim 1 wherein the concave curvature is formed by at least two bends in each length.

3. The method of installing an electric heating unit in place of a gas burner of a gas operated recreational vehicle range having a control panel, a range top deck, and a plurality of recesses in the deck with a hole through each recess beneath which is a gas burner connected in fluid communication to a pilot light by means of a pilot tube and over which is a burner grate, a gas control valve for each burner mounted in the control panel and connected with gas conducting pipes to a central gas line with gas provided through the valve to the burner by means of a gas tube connected in fluid communication therebetween, the central gas line being connected to a gas regulator to which is attached an external main gas line supplying gas to the range, comprising the following steps:

1. removing the burner grate over the burner to be replaced leaving holes in the range deck in which the grate was fit,
2. removing the regulator from the main gas line with the gas supply disconnected,
3. detaching all burners from the range,
4. removing the gas burner to be replaced and its attached gas tube and pilot tube,
5. removing the central gas tube with gas control valves from the range front panel,
6. removing a gas control valve associated with the removed burner from the central gas line, leaving a threaded hole in the line,
7. inserting a threaded plug in the threaded hole of the central gas line from which the gas control valve was removed,
8. reattaching the central gas line and remaining gas burners with their associated control valves, gas tubes and pilot tubes operatively associated therewith to the range,
9. reconnecting the regulator to the external main gas supply line,
10. mounting an electric power control in the range control panel replacing the removed gas control valve,
11. inserting the electric heating element in the vacated range top recess,
12. electrically connecting the electric power control to the electric heating element and the power control to an external power source.

4. The process of claim 3 further comprising the step of securing the heating element to the range deck recess with a spring clip, the spring clip comprising two lengths joined at a first bend forming a first point of flexure, the lengths extending from the first bend approximately in parallel to a point of second bend for each length forming a channel therebetween, each length then bending at its respective point of second bend away from the other length in an upward-oriented, concave curvature forming a second point of flexure, by fitting the spring clip channel over a radial support placed in the recess, the spring clip curved lengths compressed under spring bias, flexing the spring clip at the first and second points of flexure through the recess hole and under the range top deck, the spring clip compressed to fit into the hole and remaining under spring tension, holding the heating element in place in the recess.

5. The process of claim 3 further comprising the step of mounting a control cover on the range over the power control.

6. The process of claim 3 wherein the step of connecting the power control to the external power source further comprises the step of inserting grate hole plugs in the grate holes of the removed burner, closing the holes left open with the removal thereof the burner grate.

7. The process of claim 3 wherein the step of inserting the heating element further comprises the step of drilling a power cord hole in the range and passing the power cord therethrough.

8. The process of claim 3 further comprising the step of drilling a heating element hole in the range top recess from which the gas burner was removed and extending a heating element leg through the drilled hole when the heating element is inserted into the range top recess.

* * * * *